US011075458B2

(12) United States Patent
Jan et al.

(10) Patent No.: US 11,075,458 B2
(45) Date of Patent: Jul. 27, 2021

(54) ANTENNA SYSTEM

(71) Applicant: Wistron NeWeb Corp., Hsinchu (TW)

(72) Inventors: Cheng-Geng Jan, Hsinchu (TW); Chieh-Sheng Hsu, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 0 days.

(21) Appl. No.: 16/867,930

(22) Filed: May 6, 2020

(65) Prior Publication Data

US 2021/0057821 A1 Feb. 25, 2021

(30) Foreign Application Priority Data

Aug. 23, 2019 (TW) ..... 108130198

(51) Int. Cl.
*H01Q 5/371* (2015.01)
*H01Q 5/50* (2015.01)
*H01Q 5/321* (2015.01)

(52) U.S. Cl.
CPC ..... *H01Q 5/371* (2015.01); *H01Q 5/321* (2015.01); *H01Q 5/50* (2015.01)

(58) Field of Classification Search
CPC ..... H01Q 5/371; H01Q 5/50; H01Q 5/321; H01Q 21/0075; H01Q 21/065; H01Q 25/002; H01Q 9/0414
See application file for complete search history.

(56) References Cited

U.S. PATENT DOCUMENTS 5,717,405 A * 2/1998 Quan ..... H01Q 3/22 333/117
10,573,967 B2 * 2/2020 Hsu ..... H01Q 5/378
2004/0164917 A1 * 8/2004 Nilsson ..... H01Q 9/44 343/773
2004/0164918 A1 * 8/2004 Nilsson ..... H01Q 9/46 343/773
2005/0116862 A1 6/2005 du Toit
2006/0103582 A1 * 5/2006 Bohlman ..... H01Q 3/04 343/766
2008/0180329 A1 * 7/2008 Takeishi ..... H01Q 13/18 343/700 MS
2009/0295642 A1 * 12/2009 Nilsson ..... H01Q 11/04 343/700 MS (Continued)

*Primary Examiner* — Lam T Mai
(74) *Attorney, Agent, or Firm* — McClure, Qualey & Rodack, LLP

(57) ABSTRACT

An antenna system includes at least one antenna array. The antenna array includes a dielectric substrate, a ground plane, a first radiation element, a second radiation element, a third radiation element, a fourth radiation element, a first feeding element, and a second feeding element. The second radiation element is adjacent to the first radiation element. The first radiation element is positioned between the second radiation element and the ground plane. The fourth radiation element is adjacent to the third radiation element. The third radiation element is positioned between the fourth radiation element and the ground plane. The first feeding element is coupled to a first connection point on the first radiation element and a second connection point on the third radiation element. The second feeding element is coupled to a third connection point on the first radiation element and a fourth connection point on the third radiation element.

20 Claims, 8 Drawing Sheets

(56) References Cited

U.S. PATENT DOCUMENTS

| | | | | |
|---|---|---|---|---|
| 2010/0073237 | A1* | 3/2010 | Pidwerbetsky | H01Q 21/24 343/700 MS |
| 2012/0026054 | A1* | 2/2012 | Liu | H01Q 21/0075 343/824 |
| 2012/0146872 | A1* | 6/2012 | Chainon | H01Q 19/24 343/818 |
| 2013/0076582 | A1* | 3/2013 | Nysen | H01Q 1/243 343/770 |
| 2016/0197405 | A1* | 7/2016 | Higaki | H01Q 21/065 343/852 |
| 2018/0198191 | A1* | 7/2018 | So | H01Q 21/0075 |
| 2019/0027814 | A1* | 1/2019 | Hsu | H01Q 19/22 |
| 2019/0267710 | A1* | 8/2019 | Jenwatanavet | H01Q 9/0407 |
| 2019/0273315 | A1* | 9/2019 | Hu | H01Q 21/08 |
| 2019/0386393 | A1* | 12/2019 | Chiang | H01Q 25/001 |
| 2020/0259271 | A1* | 8/2020 | Lin | H01Q 25/02 |
| 2020/0319293 | A1* | 10/2020 | Kuriyama | H01Q 25/00 |
| 2020/0321697 | A1* | 10/2020 | Zimmerman | H01Q 21/26 |
| 2021/0036437 | A1* | 2/2021 | Zhang | H01Q 21/245 |

* cited by examiner

ANTENNA SYSTEM

CROSS REFERENCE TO RELATED APPLICATIONS

This application claims priority of Taiwan Patent Application No. 108130198 filed on Aug. 23, 2019, the entirety of which is incorporated by reference herein.

BACKGROUND OF THE INVENTION

Field of the Invention

The disclosure generally relates to an antenna system, and more particularly, to an antenna system with wide beam-width and high gain.

Description of the Related Art

With the advancements being made in mobile communication technology, mobile devices such as portable computers, mobile phones, multimedia players, and other hybrid functional portable electronic devices have become more common. To satisfy consumer demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Wireless access points allow mobile devices in a room to connect to the Internet at high speeds. However, serious signal reflection and multipath fading may be experienced in an indoor environment, and so wireless access points should process signals having different polarization directions from a variety of transmission directions simultaneously. Accordingly, it has become a critical challenge for antenna designers to design a multi-polarized antenna system with wide beam-width and high gain in the limited space of a wireless access point.

BRIEF SUMMARY OF THE INVENTION

In an exemplary embodiment, the invention is directed to an antenna system that includes a first antenna group. The first antenna group includes a first antenna array. The first antenna array includes a dielectric substrate, a ground plane, a first radiation element, a second radiation element, a third radiation element, a fourth radiation element, a first feeding element, and a second feeding element. The dielectric substrate has a first surface and a second surface which are opposite to each other. The ground plane is disposed on the first surface of the dielectric substrate. The second radiation element is disposed adjacent to the first radiation element, and is separated from the first radiation element. The first radiation element is positioned between the second radiation element and the ground plane. The fourth radiation element is disposed adjacent to the third radiation element, and is separated from the third radiation element. The third radiation element is positioned between the fourth radiation element and the ground plane. The first feeding element has a first feeding point. The first feeding element is disposed on the second surface of the dielectric substrate. The first feeding element is coupled to a first connection point on the first radiation element, and is coupled to a second connection point on the third radiation element. The second feeding element has a second feeding point. The second feeding element is disposed on the second surface of the dielectric substrate. The second feeding element is coupled to a third connection point on the first radiation element, and is coupled to a fourth connection point on the third radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
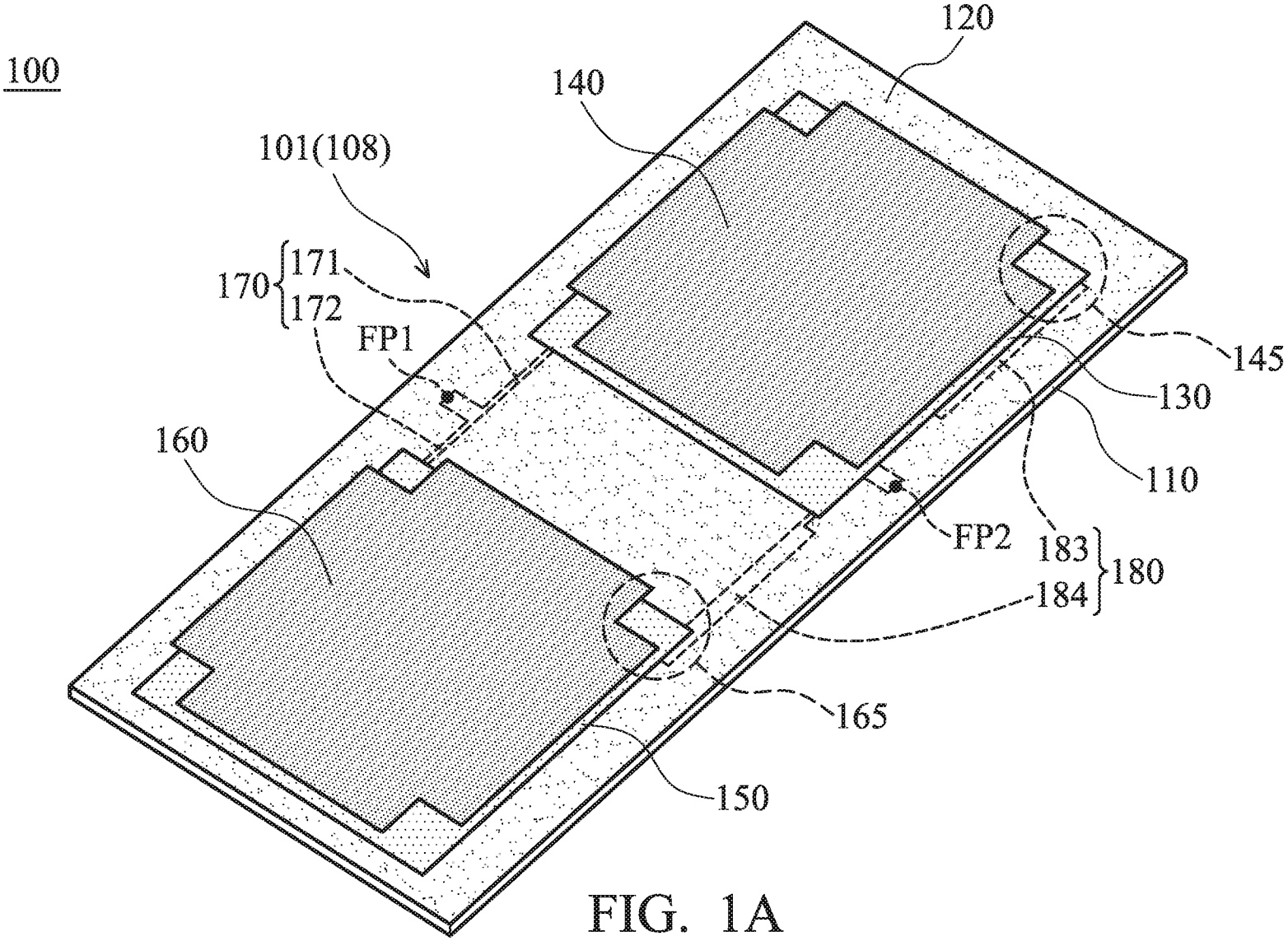
FIG. 1A is a perspective view of an antenna system according to an embodiment of the invention.
Figure 1B:
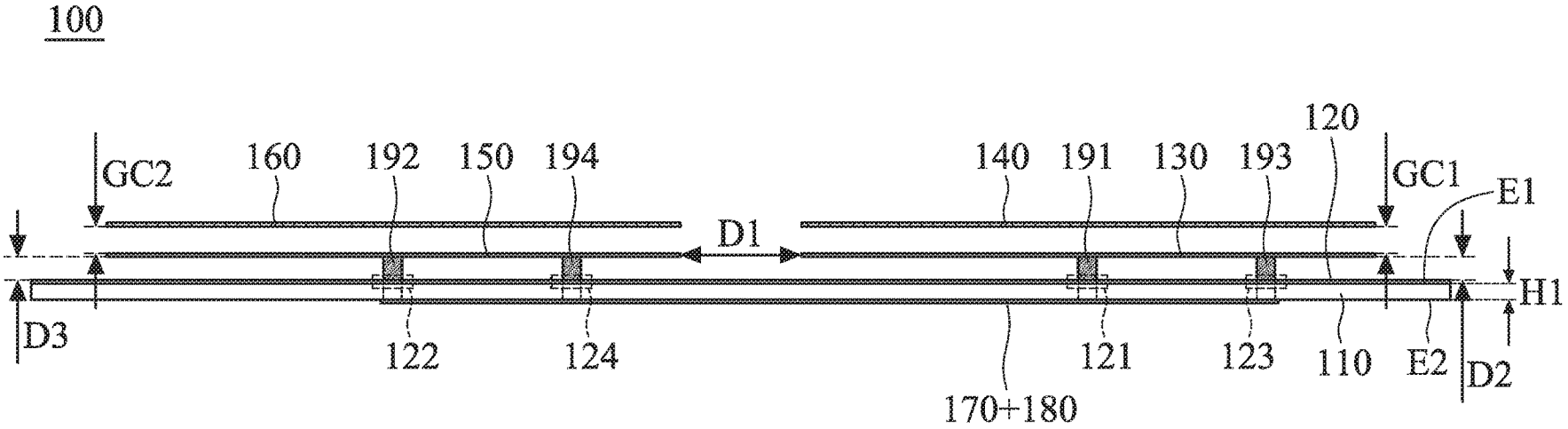
FIG. 1B is a side view of an antenna system according to an embodiment of the invention.
Figure 1C:
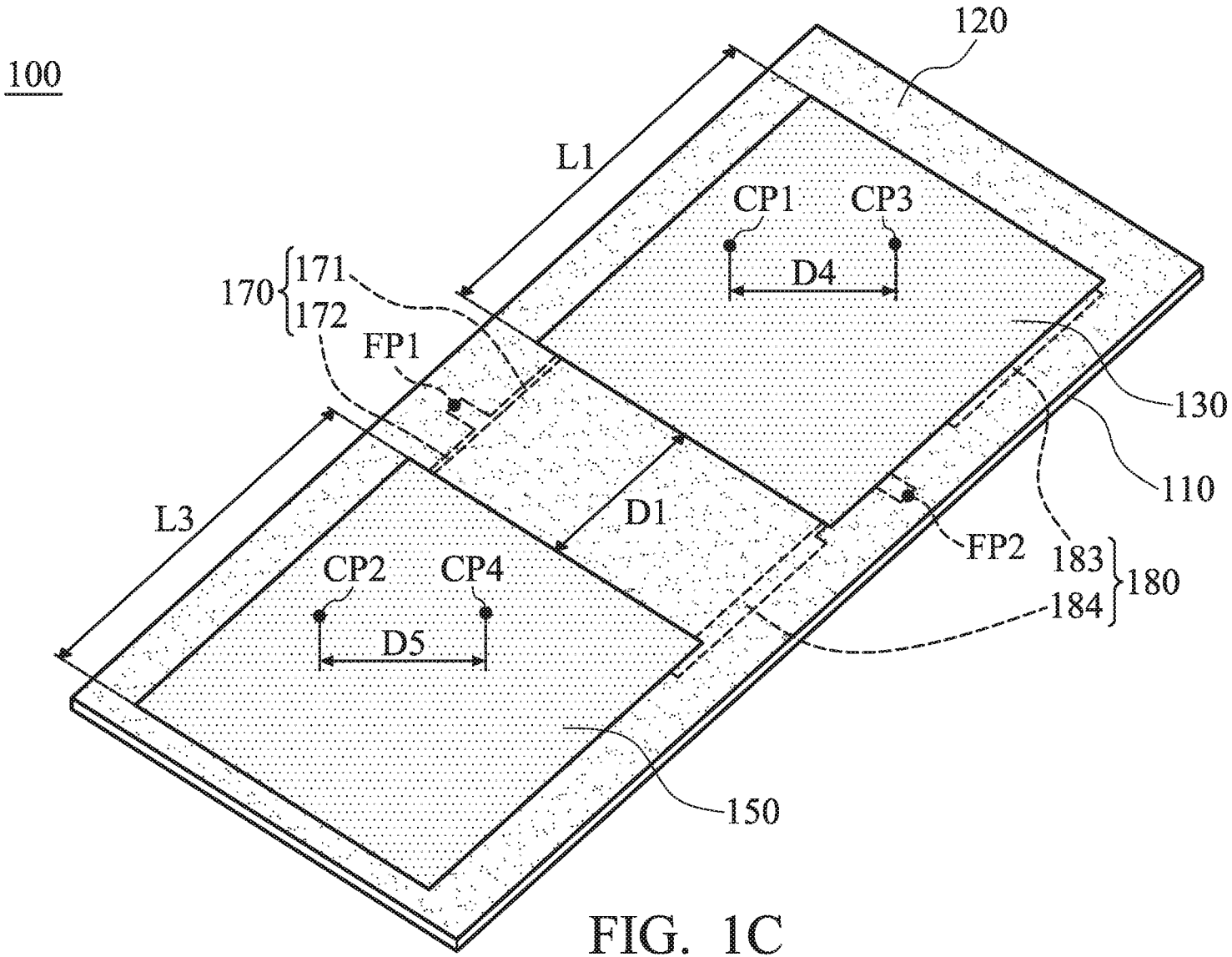
FIG. 1C is a perspective view of an antenna system according to an embodiment of the invention.
Figure 1D:
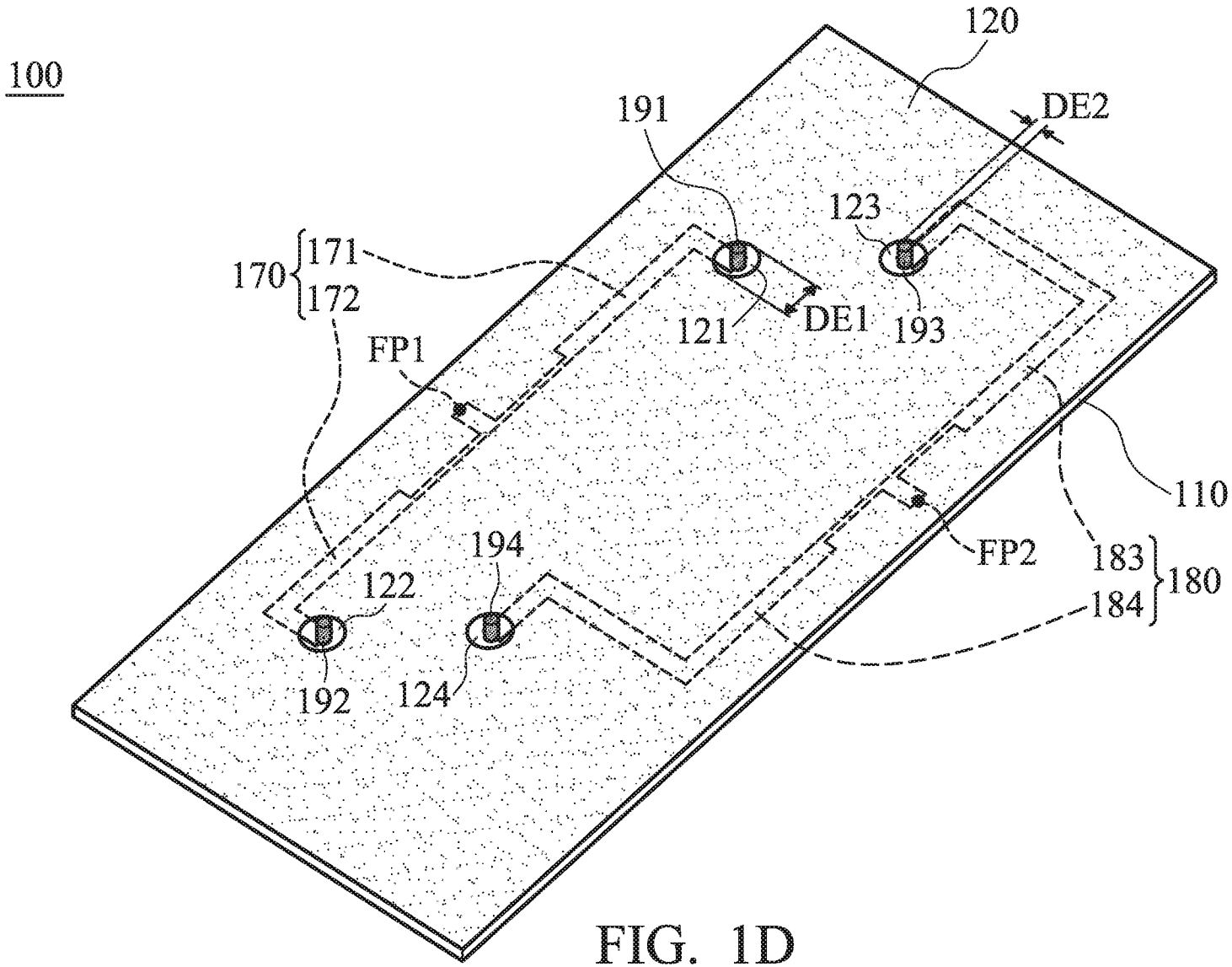
FIG. 1D is a perspective view of an antenna system according to an embodiment of the invention.

FIG. 1A is a perspective view of an antenna system 100 according to an embodiment of the invention. FIG. 1B is a side view of the antenna system 100 according to an embodiment of the invention. The antenna system 100 may be applied to a wireless access point. As shown in FIG. 1A and FIG. 1B, the antenna system 100 at least includes a first antenna group 101, and the first antenna group 101 at least includes a first antenna array 108. Specifically, the first antenna array 108 includes a dielectric substrate 110, a ground plane 120, a first radiation element 130, a second radiation element 140, a third radiation element 150, a fourth radiation element 160, a first feeding element 170, and a second feeding element 180. The dielectric substrate 110 may be an FR4 (Flame Retardant 4) substrate. The ground plane 120, the first radiation element 130, the second radiation element 140, the third radiation element 150, the fourth radiation element 160, the first feeding element 170, and the second feeding element 180 may all be made of metal materials. FIG. 1C is a perspective view of the antenna system 100 according to an embodiment of the invention. To simply the figure, the second radiation element 140 and the fourth radiation element 160 are removed from FIG. 1C. FIG. 1D is a perspective view of the antenna system 100 according to an embodiment of the invention. To simply the figure, the first radiation element 130, the second radiation element 140, the third radiation element 150, and the fourth radiation element 160 are removed from FIG. 1D. Please refer to FIG. 1A, FIG. 1B, FIG. 1C, and FIG. 1D together and understand the invention.

The dielectric substrate 110 has a first surface E1 and a second surface E2 which are opposite to each other. The ground plane 120 is disposed on the first surface E1 of the dielectric substrate 110. The first feeding element 170 and the second feeding element 180 are both disposed on the second surface E2 of the dielectric substrate 110.

The first radiation element 130 may substantially have a square shape. The first radiation element 130 is positioned between the second radiation element 140 and the ground plane 120. The second radiation element 140 may substantially have a cross shape. For example, the second radiation element 140 may have four corner notches 145, and each of the corner notches 145 may substantially have a relatively small square shape. In alternative embodiments, the second radiation element 140 substantially has a square shape. The second radiation element 140 is floating. Specifically, the second radiation element 140 is disposed adjacent to the first radiation element 130, and the second radiation element 140 is completely separated from the first radiation element 130. A first coupling gap GC1 is formed between the first radiation element 130 and the second radiation element 140. It should be noted that the term "adjacent" or "close" over the disclosure means that the distance (spacing) between two corresponding elements is smaller than a predetermined distance (e.g., 5 mm or the shorter), but usually does not mean that the two corresponding elements directly touch each other (i.e., the aforementioned distance/spacing therebetween is reduced to 0). In some embodiments, the second radiation element 140 has a vertical projection on the first radiation element 130, and the whole vertical projection is inside the first radiation element 130.

The third radiation element 150 may substantially have a square shape. The third radiation element 150 is positioned between the fourth radiation element 160 and the ground plane 120. The fourth radiation element 160 may substantially have a cross shape. For example, the fourth radiation element 160 may have four corner notches 165, and each of the corner notches 165 may substantially have a relatively small square shape. In alternative embodiments, the fourth radiation element 160 substantially has a square shape. The fourth radiation element 160 is floating. Specifically, the fourth radiation element 160 is disposed adjacent to the third radiation element 150, and the fourth radiation element 160 is completely separated from the third radiation element 150. A second coupling gap GC2 is formed between the third radiation element 150 and the fourth radiation element 160. In some embodiments, the fourth radiation element 160 has a vertical projection on the third radiation element 150, and the whole vertical projection is inside the third radiation element 150.

The first feeding element 170 has a first feeding point FP1 at its central point. The first feeding point FP1 may be coupled to a first signal source (not shown). Specifically, the first feeding element 170 includes a first branch 171 and a second branch 172, which have the same lengths and extend away from each other. The first feeding element 170 is coupled to a first connection point CP1 on the first radiation element 130, and is coupled to a second connection point CP2 on the third radiation element 150. The second feeding element 180 has a second feeding point FP2 at its central point. The second feeding point FP2 may be coupled to a second signal source (not shown). Specifically, the second feeding element 180 includes a third branch 183 and a fourth branch 184, which have the same lengths and extend away from each other. The second feeding element 180 is coupled to a third connection point CP3 on the first radiation element 130, and is coupled to a fourth connection point CP4 on the third radiation element 150. It should be noted that the third connection point CP3 is different from the first connection point CP1, and the fourth connection point CP4 is different from the second connection point CP2.

In some embodiments, the ground plane 120 has a first opening 121, a second opening 122, a third opening 123, and a fourth opening 124. Also, the first antenna array 108 further includes a first conductive via element 191, a second conductive via element 192, a third conductive via element 193, and a fourth conductive via element 194. Each of the first opening 121, the second opening 122, the third opening 123, and the fourth opening 124 may substantially have a circular shape. Each of the first conductive via element 191, the second conductive via element 192, the third conductive via element 193, and the fourth conductive via element 194 may substantially have a cylindrical column. However, the invention is not limited thereto. In alternative embodiments, each of the first opening 121, the second opening 122, the third opening 123, and the fourth opening 124 substantially has a square shape, a rectangular shape, a regular triangular shape, or a regular hexagonal shape, and each of the first conductive via element 191, the second conductive via element 192, the third conductive via element 193, and the fourth conductive via element 194 substantially has a triangular column, a square column, or a hexagonal column.

The first conductive via element 191 penetrates the dielectric substrate 110, and extends into the first opening 121 of the ground plane 120. The second conductive via element 192 penetrates the dielectric substrate 110, and extends into the second opening 122 of the ground plane 120. The third conductive via element 193 penetrates the dielectric substrate 110, and extends into the third opening 123 of the ground plane 120. The fourth conductive via element 194 penetrates the dielectric substrate 110, and extends into the fourth opening 124 of the ground plane 120. Specifically, the first feeding point FP1 is coupled through the first branch 171 of the first feeding element 170 and the first conductive via element 191 to the first connection point CP1 on the first radiation element 130, and the first feeding point FP1 is further coupled through the second branch 172 of the first feeding element 170 and the second conductive via element 192 to the second connection point CP2 on the third radiation element 150. In addition, the second feeding point FP2 is coupled through the third branch 183 of the second feeding element 180 and the third conductive via element 193 to the third connection point CP3 on the first radiation element 130, and the second feeding point FP2 is further coupled through the fourth branch 184 of the second feeding element 180 and the fourth conductive via element 194 to the fourth connection point CP4 on the third radiation element 150.

In some embodiments, the operation principles of the first antenna array 108 are described as follows. The first antenna array 108 is considered as a 1×2 antenna array. A first antenna element of the first antenna array 108 is formed by the first radiation element 130 and the second radiation element 140. A second antenna element of the first antenna array 108 is formed by the third radiation element 150 and the fourth radiation element 160. The structure of the second antenna element may be identical to that of the first antenna element. According to practical measurements, the in-phase feeding mechanism of the first feeding element 170 makes both the first antenna element and the second antenna element capable to receive or transmit horizontally-polarized signals, and the in-phase feeding mechanism of the second feeding element 180 makes both the first antenna element and the second antenna element capable to receive or transmit vertically-polarized signals. With such a design, the first antenna array 108 can support at least dual-polarized signal transmission.

Figure 2:
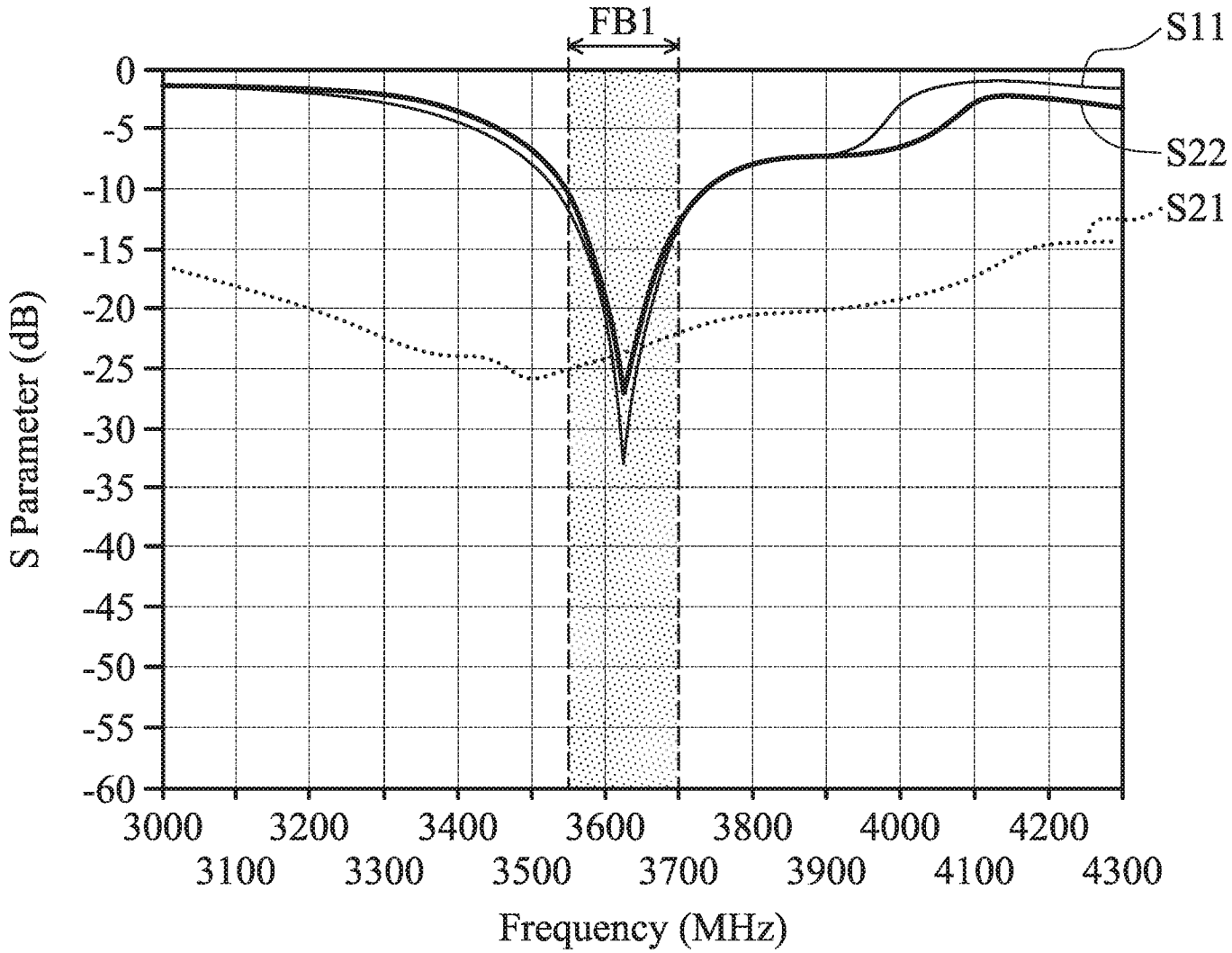
FIG. 2 is a diagram of S-parameters of a first antenna array according to an embodiment of the invention.

FIG. 2 is a diagram of S-parameters of the first antenna array 108 according to an embodiment of the invention. The horizontal axis represents operation frequency (MHz), and the vertical axis represents S-parameters (dB). In the embodiment of FIG. 2, the first feeding point FP1 is used as a first port (Port 1), and the second feeding point FP2 is used as a second port (Port 2). According to the S11-parameter curve and the S22-parameter curve of FIG. 2, the first antenna array 108 can cover an operation frequency band FB1 from 3550 MHz to 3700 MHz, so as to support the wideband operation of LTE (Long Term Evolution) Band 48. According to the S21-parameter curve of FIG. 2, within the aforementioned operation frequency band FB1, the isolation (i.e., the absolute value of the S21-parameter) of the first antenna array 108 may reach about 22 dB, thereby effectively reducing the interference between the antennas. In alternative embodiments, the operation frequency band FB1 is adjustable according to different requirements.

In some embodiments, the element sizes of the first antenna array 108 are described as follows. The thickness H1 of the dielectric substrate 110 (i.e., the distance between the first surface E1 and the second surface E2) may be from 0.8 mm to 1.6 mm, such as 1 mm. The length L1 of the first radiation element 130 may be substantially equal to 0.5 wavelength (λ/2) of the operation frequency band FB1 of the first antenna array 108. The length L3 of the third radiation element 150 may be substantially equal to 0.5 wavelength (λ/2) of the operation frequency band FB1 of the first antenna array 108. The distance D1 between the first radiation element 130 and the third radiation element 150 (i.e., the distance between the first antenna element and the second antenna element) may be substantially equal to 0.5 wavelength (λ/2) of the operation frequency band FB1 of the first antenna array 108. The width of the first coupling gap GC1 may be from 1 mm to 3 mm, such as 2 mm. The width of the second coupling gap GC2 may be from 1 mm to 3 mm, such as 2 mm. The distance D2 between the ground plane 120 and the first radiation element 130 may be from 1 mm to 2 mm, such as 1.5 mm. The distance D3 between the ground plane 120 and the third radiation element 150 may be from 1 mm to 2 mm, such as 1.5 mm. The diameter DE1 of each of the first opening 121, the second opening 122, the third opening 123, and the fourth opening 124 may be from 2 mm to 6 mm, such as 4 mm. The diameter DE2 of each of the first conductive via element 191, the second conductive via element 192, the third conductive via element 193, and the fourth conductive via element 194 may be from 1 mm to 2 mm, such as 1.2 mm. The distance D4 between the first connection point CP1 and the third connection point CP3 may be from 10 mm to 20 mm, such as 15 mm. The distance D5 between the second connection point CP2 and the fourth connection point CP4 may be from 10 mm to 20 mm, such as 15 mm. The above ranges of element sizes are calculated and obtained according to many experiment results, and they help to optimize the operation bandwidth, the impedance matching, and the multi-polarized characteristic of the first antenna array 108.

Figure 3A:
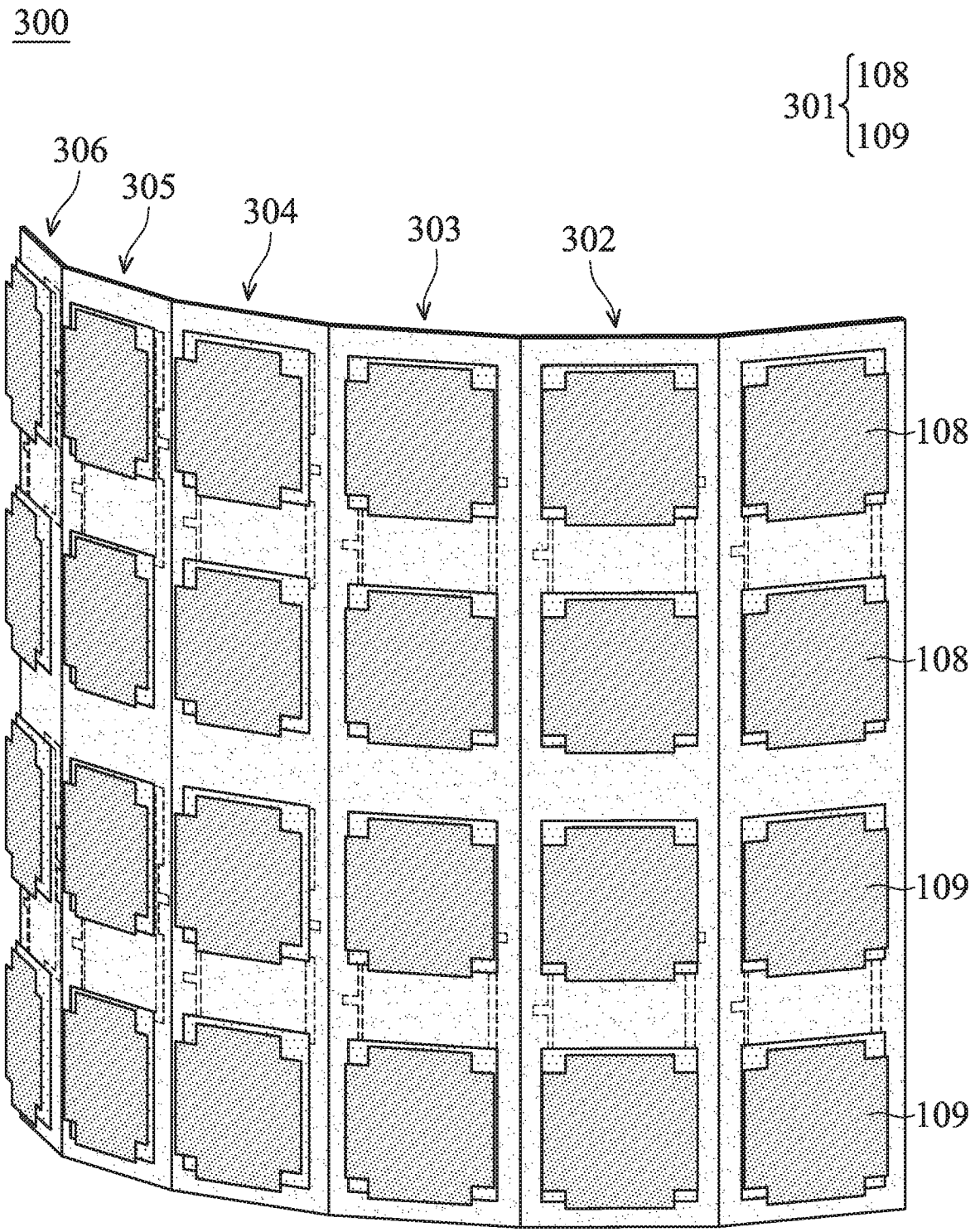
FIG. 3A is a perspective view of an antenna system according to another embodiment of the invention.
Figure 3B:
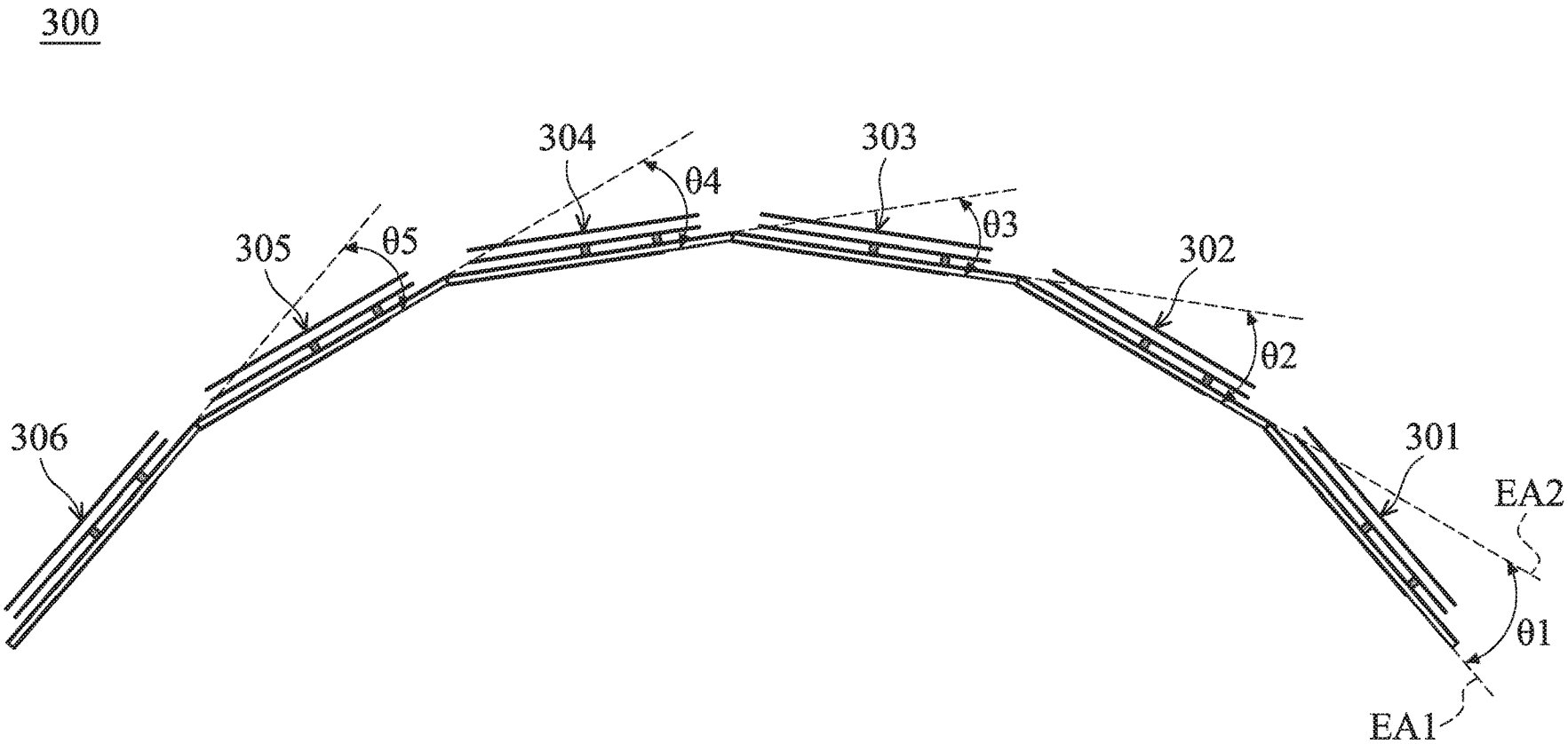
FIG. 3B is a side view of an antenna system according to another embodiment of the invention.

FIG. 3A is a perspective view of an antenna system 300 according to another embodiment of the invention. FIG. 3B is a side view of the antenna system 300 according to another embodiment of the invention. Please refer to FIG. 3A and FIG. 3B together. FIG. 3A and FIG. 3B are similar to FIG. 1A, FIG. 1B, FIG. 1C, and FIG. 1D. In the embodiment of FIG. 3A and FIG. 3B, the antenna system 300 includes at least two or all of a first antenna group 301, a second antenna group 302, a third antenna group 303, a fourth antenna group 304, a fifth antenna group 305, and a sixth antenna group 306. For example, the first antenna group 301 may include a first antenna array 108 and a second antenna array 109 which are adjacent to each other. The structural features of the first antenna array 108 have been described in the embodiments of FIG. 1A, FIG. 1B, FIG. 1C, and FIG. 1D. The structure of the second antenna array 109 may be identical to that of the first antenna array 108. The second antenna array 109 can share the first feeding point FP1 and the second feeding point FP2 with the first antenna array 108. That is, the first antenna group 301 is considered as a 1×4 antenna array. Furthermore, the structure of each of the second antenna group 302, the third antenna group 303, the fourth antenna group 304, the fifth antenna group 305, and the sixth antenna group 306 may be identical to that of the first antenna group 301, and they will not be illustrated again herein. It should be noted that the total number of antenna groups of the antenna system 300 and the total number of antenna arrays of each antenna group are merely exemplary, and they are adjustable according to different requirements.

Specifically, the first antenna group 301 is positioned on a first plane EA1, and the second antenna group 302 is positioned on a second plane EA2. There is an angle θ1 between the first antenna group 301 and the second antenna group 302. The angle θ1 may be defined as the angle between the first plane EA1 and the second plane EA2 (or the angle between two dielectric substrates of the first antenna group 301 and the second antenna group 302). Similarly, there is an angle θ2 between the second antenna group 302 and the third antenna group 303, there is an angle θ3 between the third antenna group 303 and the fourth antenna group 304, there is an angle θ4 between the fourth antenna group 304 and the fifth antenna group 305, and there is an angle θ5 between the fifth antenna group 305 and the sixth antenna group 306. For example, each of the angles θ1, θ2, θ3, θ4 and θ5 may be the same and from 0 to 120 degrees (e.g., from 0 to 60 degrees). All of the angles θ1, θ2, θ3, θ4 and θ5 may be equal to about 20 degrees. With such a design, the first antenna group 301, the second antenna group 302, the third antenna group 303, the fourth antenna group 304, the fifth antenna group 305, and the sixth antenna group 306 of the antenna system 300 are considered as a 6×4 antenna array for providing larger beam-width and higher gain.

Figure 4:
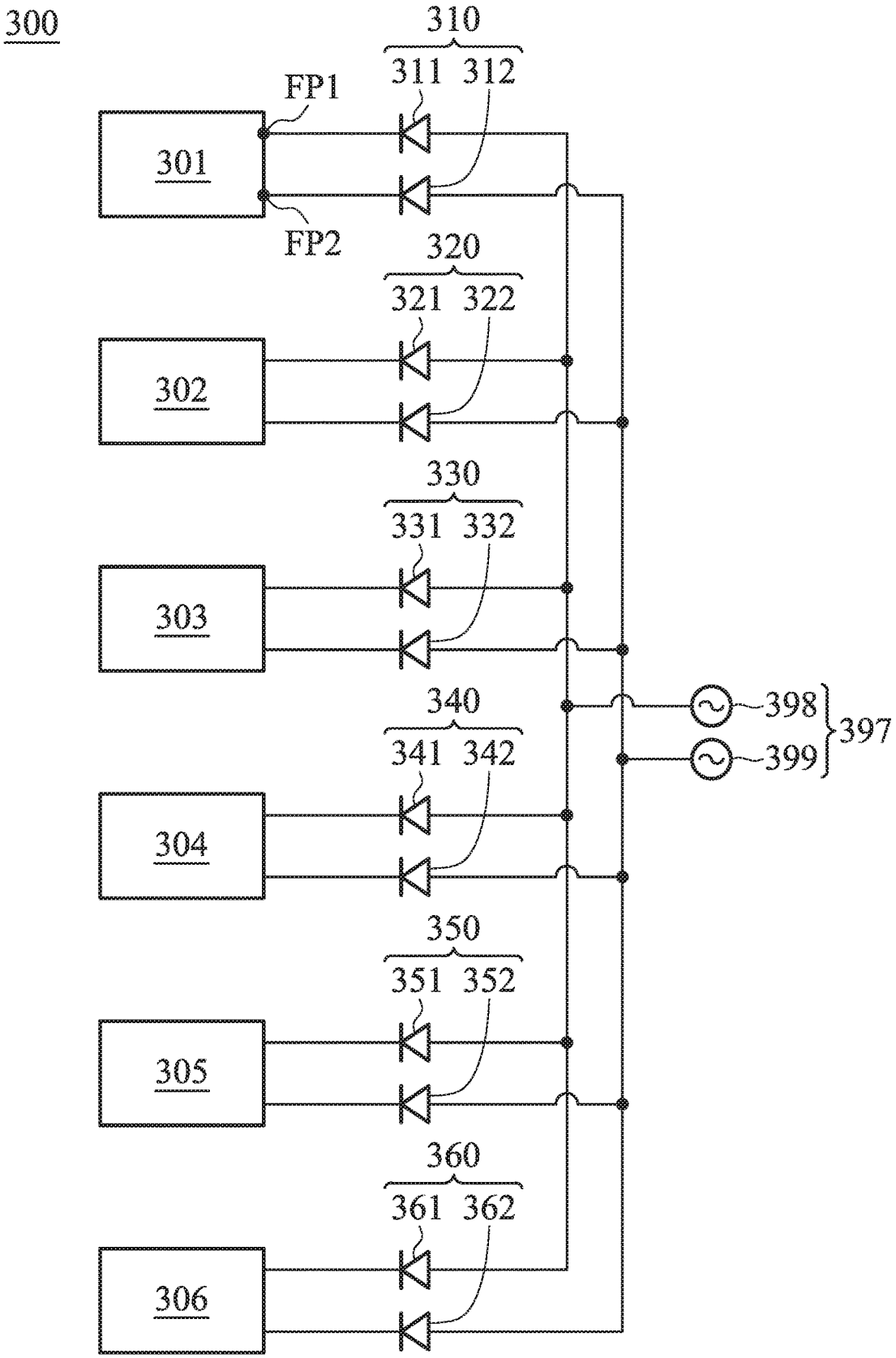
FIG. 4 is an equivalent circuit diagram of an antenna system according to another embodiment of the invention.

FIG. 4 is an equivalent circuit diagram of the antenna system 300 according to another embodiment of the invention. In the embodiment of FIG. 4, the antenna system 300 further includes an RF (Radio Frequency) module 397, a first switch element 310, a second switch element 320, a third switch element 330, a fourth switch element 340, a fifth switch element 350, and a sixth switch element 360. The first switch element 310 is coupled between the RF module 397 and the first antenna group 301. The second switch element 320 is coupled between the RF module 397 and the second antenna group 302. The third switch element 330 is coupled between the RF module 397 and the third antenna group 303. The fourth switch element 340 is coupled between the RF module 397 and the fourth antenna group 304. The fifth switch element 350 is coupled between the RF module 397 and the fifth antenna group 305. The sixth switch element 360 is coupled between the RF module 397 and the sixth antenna group 306.

Specifically, the first switch element 310 includes a first switch unit 311 and a second switch unit 312. For example, each of the first switch unit 311 and the second switch unit 312 may be implemented with a diode. The RF module 397 includes a first signal source 398 and a second signal source 399. The first signal source 398 may correspond to horizontally-polarized signals. The second signal source 399 may correspond to vertically-polarized signals. The first signal source 398 is coupled through the first switch unit 311 to the first feeding point FP1 of the first antenna group 301. The second signal source 399 is coupled through the second switch unit 312 to the second feeding point FP2 of the first antenna group 301. The first switch unit 311 and the second switch unit 312 are closed or open according to a control signal or a user's input, so as to selectively enable or disable the first antenna group 301. Similarly, the second switch element 320 includes a third switch unit 321 and a fourth switch unit 322 for selectively enabling or disabling the second antenna group 302, the third switch element 330 includes a fifth switch unit 331 and a sixth switch unit 332 for selectively enabling or disabling the third antenna group 303, the fourth switch element 340 includes a seventh switch unit 341 and an eighth switch unit 342 for selectively enabling or disabling the fourth antenna group 304, the fifth switch element 350 includes a ninth switch unit 351 and a tenth switch element 352 for selectively enabling or disabling the fifth antenna group 305, and the sixth switch element 360 includes an eleventh switch unit 361 and a twelfth switch unit 362 for selectively enabling or disabling the sixth antenna group 306.

In some embodiments, the antenna system 300 is configured as a beam switching antenna assembly, such that N adjacent antenna groups among the first antenna group 301, the second antenna group 302, the third antenna group 303, the fourth antenna group 304, the fifth antenna group 305, and the sixth antenna group 306 are all enabled, and the other antenna groups are all disabled. According to practical measurements, N may be 2, 3, or 4, so as to maintain large beam-width and high gain of the antenna system 300. For example, if N is equal to 3, the second antenna group 302, the third antenna group 303, and the fourth antenna group 304 which are adjacent to each other may all be enabled, and the other antenna groups may all be disabled. By selecting different antenna groups, the main beam of the antenna system 300 can be set toward the desired direction. With such a design, the total beam-width of the antenna system 300 can reach about 120 degrees, and the maximum gain of the antenna system 300 can reach about 16.2 dBi. This can meet the requirements of practical application of general MIMO (Multi-Input and Multi-Output) systems. It should be noted that the antenna system 300 does not use expensive phase shifters as conventional designs, and each switch element may be implemented with cheap diodes, thereby significantly reducing the total manufacturing cost.

The invention proposes a novel antenna system. In comparison to the conventional design, the invention has at least the advantages of large beam-width, high antenna gain, high isolation, and low manufacturing cost. The invention is suitable for application in a variety of indoor environments, so as to solve the problem of poor communication quality due to signal reflection and multipath fading in conventional designs.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-4. The invention may merely include any one or more features of any one or more embodiments of FIGS. 1-4. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a first antenna group, comprising a first antenna array, wherein the first antenna array comprises:

a dielectric substrate, having a first surface and a second surface opposite to each other;

a ground plane, disposed on the first surface of the dielectric substrate;

a first radiation element;

a second radiation element, disposed adjacent to the first radiation element, and separated from the first radiation element, wherein the first radiation element is positioned between the second radiation element and the ground plane;

a third radiation element;

a fourth radiation element, disposed adjacent to the third radiation element, and separated from the third radiation element, wherein the third radiation element is positioned between the fourth radiation element and the ground plane;

a first feeding element, having a first feeding point, and disposed on the second surface of the dielectric substrate, wherein the first feeding element is coupled to a first connection point on the first radiation element and is coupled to a second connection point on the third radiation element; and a second feeding element, having a second feeding point, and disposed on the second surface of the dielectric substrate, wherein the second feeding element is coupled to a third connection point on the first radiation element and is coupled to a fourth connection point on the third radiation element.

2. The antenna system as claimed in claim 1, wherein the antenna system covers an operation frequency band from 3550 MHz to 3700 MHz.

3. The antenna system as claimed in claim 1, wherein each of the first radiation element and the third radiation element substantially has a square shape.

4. The antenna system as claimed in claim 1, wherein each of the second radiation element and the fourth radiation element substantially has a cross shape.

5. The antenna system as claimed in claim 1, wherein the first feeding element comprises a first branch and a second branch, and the second feeding element comprises a third branch and a fourth branch.

6. The antenna system as claimed in claim 5, wherein the ground plane has a first opening, a second opening, a third opening, and a fourth opening.

7. The antenna system as claimed in claim 6, wherein the first antenna array further comprises:

a first conductive via element, penetrating the dielectric substrate, and extending into the first opening of the ground plane;

a second conductive via element, penetrating the dielectric substrate, and extending into the second opening of the ground plane;

a third conductive via element, penetrating the dielectric substrate, and extending into the third opening of the ground plane; and a fourth conductive via element, penetrating the dielectric substrate, and extending into the fourth opening of the ground plane.

8. The antenna system as claimed in claim 7, wherein the first feeding point is coupled through the first branch of the first feeding element and the first conductive via element to the first connection point on the first radiation element, the first feeding point is further coupled through the second branch of the first feeding element and the second conductive via element to the second connection point on the third radiation element, the second feeding point is coupled through the third branch of the second feeding element and the third conductive via element to the third connection point on the first radiation element, and the second feeding point is further coupled through the fourth branch of the second feeding element and the fourth conductive via element to the fourth connection point on the third radiation element.

9. The antenna system as claimed in claim 2, wherein a length of each of the first radiation element and the third radiation element is substantially equal to 0.5 wavelength of the operation frequency band.

10. The antenna system as claimed in claim 2, wherein a distance between the first radiation element and the third radiation element is substantially equal to 0.5 wavelength of the operation frequency band.

11. The antenna system as claimed in claim 1, wherein a first coupling gap is formed between the first radiation element and the second radiation element, a second coupling gap is formed between the third radiation element and the fourth radiation element, and a width of each of the first coupling gap and the second coupling gap is from 1 mm to 3 mm.

12. The antenna system as claimed in claim 1, wherein a distance between the ground plane and each of the first radiation element and the third radiation element is from 1 mm to 2 mm.

13. The antenna system as claimed in claim 1, wherein the first antenna group further comprises a second antenna array, and the second antenna array and the first antenna array have identical structures.

14. The antenna system as claimed in claim 1, further comprises:

a second antenna group, wherein the second antenna group and the first antenna group have identical structures.

15. The antenna system as claimed in claim 14, wherein the first antenna group is positioned on a first plane, the second antenna group is positioned on a second plane, and an angle between the first plane and the second plane is from 0 to 120 degrees.

16. The antenna system as claimed in claim 14, further comprises:

a third antenna group, wherein the third antenna group and the first antenna group have identical structures;

a fourth antenna group, wherein the fourth antenna group and the first antenna group have identical structures;

a fifth antenna group, wherein the fifth antenna group and the first antenna group have identical structures; and a sixth antenna group, wherein the sixth antenna group and the first antenna group have identical structures.

17. The antenna system as claimed in claim 16, further comprises:

an RF (Radio Frequency) module;

a first switch element, coupled between the RF module and the first antenna group;

a second switch element, coupled between the RF module and the second antenna group;

a third switch element, coupled between the RF module and the third antenna group;

a fourth switch element, coupled between the RF module and the fourth antenna group;

a fifth switch element, coupled between the RF module and the fifth antenna group; and a sixth switch element, coupled between the RF module and the sixth antenna group.

18. The antenna system as claimed in claim 17, wherein the first switch element, the second switch element, the third switch element, the fourth switch element, the fifth switch element, and the sixth switch element are implemented with a plurality of diodes.

19. The antenna system as claimed in claim 16, wherein N adjacent antenna groups among the first antenna group, the second antenna group, the third antenna group, the fourth antenna group, the fifth antenna group, and the sixth antenna group are enabled, and the other antenna groups are disabled.

20. The antenna system as claimed in claim 19, wherein N is equal to 2, 3 or 4.

* * * * *